US006340446B1

(12) United States Patent
Kita et al.

(10) Patent No.: US 6,340,446 B1
(45) Date of Patent: Jan. 22, 2002

(54) NICKEL-FREE WHITE COPPER ALLOY

(75) Inventors: Kazuhiko Kita, Sendai; Yasuhiko Sugimoto, Kamiichi-machi; Yasuharu Yoshimura; Takahiro Fukuyama, both of Kurobe, all of (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/549,541

(22) Filed: Apr. 14, 2000

(30) Foreign Application Priority Data

Apr. 16, 1999 (JP) ..... 11-109648

(51) Int. Cl.[7] ..... C22C 9/05

(52) U.S. Cl. ..... 420/480; 420/482; 420/489; 148/434; 148/436

(58) Field of Search ..... 420/480, 482, 420/489; 148/434, 436

(56) References Cited

FOREIGN PATENT DOCUMENTS

| | | |
|---|---|---|
| EP | 0 545 231 | 9/1993 |
| EP | 0 678 586 | 10/1995 |
| JP | 09202931 | 5/1997 |

*Primary Examiner*—Deborah Yee
(74) *Attorney, Agent, or Firm*—Finnegan, Henderson, Farabow, Garrett & Dunner, L.L.P.

(57) ABSTRACT

A nickel-free white copper alloy represented by the general formula: $Cu_aZn_bMn_cAl_d$ or $Cu_aZn_bMn_cAl_dX_e$, wherein X is at least one element selected from the group consisting of Si, Ti and Cr; b, c, d and e are $0.5 \leqq b < 5$, $7 \leqq c \leqq 17$, $0.5 \leqq d \leqq 4$ and $0 < e \leqq 0.3$ in terms of % by weight; a is the balance, the alloy incidentally including unavoidable elements. The alloy is free from allergic problems, which may be caused by nickel, and has excellent strength, hardness, ductility, workability and corrosion resistance, suitable for use in elements, sliders, stoppers or the like for slide fasteners, or accessories such as metallic buttons, fasteners or the like for clothes.

10 Claims, No Drawings

NICKEL-FREE WHITE COPPER ALLOY

BACKGROUND OF THE INVENTION

1. Field of the Invention

The present invention relates to a nickel-free white copper alloy having excellent strength, hardness, ductility, workability and corrosion resistance, suitable for use in elements, sliders, stoppers or the like for slide fasteners, or accessories such as metallic buttons, fasteners or the like for clothes, causing no allergic problem and having high whiteness.

2. Description of the Prior Art

As conventional copper alloys, for example, for the above-mentioned fasteners, copper-nickel-zinc alloys such as nickel silver, which has a white alloy hue, or copper-zinc alloy represented by red brass or brass have been used. Since nickel silver contains nickel as an alloying element, corrosion resistance is excellent. However, for example, where this is applied to the use as a slide fastener, the fastener often contacts with a skin, and there arises the allergic problem due to nickel. Whereas the copper-zinc alloy represented by red brass or brass does not cause such an allergic problem since it contains no nickel. However, its color tone becomes yellowish, and a white alloy cannot be obtained.

SUMMARY OF THE INVENTION

Accordingly, an object of the present invention is to provide a white copper alloy having excellent strength and hardness equal to those of nickel silver, as well as excellent workability, corrosion resistance and whiteness in addition to ductility, and having no allergic problem because the alloy contains no nickel.

The present invention comprises the following (1)–(5).

(1) A nickel-free white copper alloy represented by the general formula: $Cu_aZn_bMn_cAl_d$, wherein b, c, and d are $0.5 \leqq b < 5$, $7 \leqq c \leqq 17$ and $0.5 \leqq d \leqq 4$ in terms of % by weight; and a is the balance, the alloy incidentally including unavoidable elements.

(2) A nickel-free white copper alloy, represented by the general formula: $Cu_aZn_bMn_cAl_dX_e$, wherein X is at least one element selected from the group consisting of Si, Ti and Cr; b, c, d and e are $0.5 \leqq b < 5$, $7 \leqq c \leqq 17$, $0.5 \leqq d \leqq 4$ and $0 < e \leqq 0.3$ in terms of % by weight; and a is the balance, the alloy incidentally including unavoidable elements.

(3) The nickel-free white copper alloy as described in the above (1) or (2), wherein the b, c and d are $0.5 \leqq b4$, $7 \leqq c \leqq 15$ and $0.5 \leqq d \leqq 2$ in terms of % by weight.

(4) The nickel-free white copper alloy as described in any one of the above (1), (2) and (3), wherein the alloy is a single α-phase state at room temperature.

(5) The nickel-free white copper alloy as described in any one of the above (1), (2) and (3), wherein the alloy has such a color tone that a* value and b* value representing a color tone defined by JIS Z 8729 are $0 < a^* < 5$ and $7 < b^* < 15$.

DETAILED DESCRIPTION OF THE PREFERRED EMBODIMENTS

In the composition of the present invention, Zn has an effect of improving the mechanical properties of the alloy through its solid solution strengthening effect and also a cost reduction effect of the alloy. If the Zn content is less than 0.5%, the cost reduction effect and the strengthening effect are insufficient. If the content is more than 5%, the solid-solution coexistence temperature range becomes broad and macro segregation tends to be marked. Also, heat conduction and castability tend to decrease. Further, when the Zn content is larger than 5%, season cracking resistance deteriorates and also the crystalline structure becomes an α+β phase, so that a sufficient cold-workability cannot be secured. By setting to 5% or less, the problem of season cracking does not occur and a more stable state can be maintained even if the X element defined in the aforesaid general formula $Cu_aZn_bMn_cAl_dX_e$ is added. 4% or less is more preferred. Mn has effects in providing improved mechanical properties to the alloy by the solid solution strengthening effect and also in cost reduction of the alloy. Further, by addition of Mn in the above-specified amount as a partial replacement of zinc, there occur the effect of improving the season cracking resistance as well as the effect of preventing the color tone of the copper alloy from turning to yellowish excessively. Further, it has an effect of lowering the melting point of the alloy, thus improving the castability and also suppressing vaporization of zinc from a melt. If it is less than 7%, the color tone becomes yellowish. Conversely, if it is larger than 17%, the crystal structure becomes an α+β phase, so that a sufficient cold-workability cannot be secured. The upper limit of Mn is more preferably 15%.

Al has an effect of improving the season cracking resistance by forming a stable oxide film on the alloy surface. Further, it improves the mechanical properties of the alloy through the solid solution strengthening effect and also decreases the cost of the alloy. The lower limit of the Al amount is 0.5%. When the amount is too small, the season cracking resistance and the strengthening effect become insufficient. On the other hand, if it is larger than 4%, the crystalline structure becomes an α+β phase, so that a sufficient cold-workability cannot be secured. 2% or less is more preferred.

The Element X (at least one element selected from the group consisting of Si, Ti and Cr) in the general formula $Cu_aZn_bMn_cAl_dX_e$ serves to form a coating on a melt surface during melting, and also serves to prevent oxidation of Mn and vaporization of Zn. Further, by forming a stable oxide coating on the alloy surface, there occur the functions of preventing elimination of Mn during annealing and improving the season cracking resistance and also the effect of preventing change in color tone with the lapse of time due to oxidation of Mn. The lower limit of the amount of the element X is more than 0%. However, if the amount is too small, the above effects are not sufficiently obtained. Therefore, the amount is preferably 0.02% or more. If the amount is larger than 0.3%, an intermetallic compound is formed with elements in the composition, causing deterioration of cold-workability.

The present invention alloy is composed a single α-phase, and can secure a sufficient cold-workability. If outside the composition range of the present invention, the crystalline structure tends to be an α+β phase, and the workability lowers.

Further, the present invention alloy is in ranges of $0 < a^* < 5$ and $7 < b^* < 15$ based on the chromaticity diagram of the (L* a* b*) colorimetric system if defined by JIS Z 8729.

The color tone mentioned in the present specification is shown by the values of psychometric lightness index L* (lightness: L star) and psychometric chromaticity indexes a* (greenish-reddish: a star) and b* (bluish-yellowish: b star) expressed in accordance with the specification of color of materials defined by JIS Z 8729. In particular, in order to be white color that is the characteristic of the present invention, it is better to be a color near achromatic color, which can be defined by the chromaticity indexes a* and b* as mentioned above.

The present invention is explained specifically below based on the examples.

EXAMPLES

In Examples 1–14 of the present invention shown in Table 1, test materials were prepared and evaluated as described hereinafter. The same procedure was conducted with respect to Comparative Examples 1–10 in Table 1.

Pure Cu (99.9%), pure Zn (99.9–99.99%), pure Mn (99.9%), pure Al (99.99%), pure Ti, pure Si and pure Cr were measured for making up an ingot of 200 $cm^3$ for each predetermined composition. Each composition was melted with high frequency in an Ar atmosphere (10 cmHg), maintained for 4 minutes and then poured into a copper casting mold (40 mm in diameter×28 mm in length). The ingot obtained (200 $cm^3$) was cut in a length of about 70 mm to form a billet for extrusion. Extrusion was conducted at a billet temperature of 800° C. and a container temperature of 600° C. A heat treatment at 800° C. for one hour followed by cooling in a furnace (hereinafter this sequence is referred to as "a heat treatment") was applied to the extruded material obtained (8 mm in diameter×about 1300 mm in length). The extruded material (wire) to which this heat treatment was applied was used as a base material for test.

The test materials obtained were subjected to mirror polishing with a SiC polishing paper and a diamond paste, and measured using a chromatic color-difference meter (CR-300, manufactured by Minolta Ltd.), and the results were expressed by L*, a* and b* as defined in JIS Z 8729.

All the test materials of the present invention have a white hue, and where it is used as a fastener part, a part having a high-grade feeling can be provided.

Further, each of the thus prepared test materials was observed for microcrystalline structure. The test materials of the present invention were all single α-phase alloys, and could provide a material having good cold-workability. Where a secondary phase was co-existent as in comparative examples, cracks or the like occurred during cold-working. In the materials of the inventive examples, occurrence of crack or the like was not observed. In particular, in the use as elements of a fastener, Y-shaped elements are fitted and affixed to a cloth. The fastener elements made of the inventive material can be firmly affixed to a cloth without cracking or the like.

Hardness (Hv) is shown by values DPN measured by a Vickers microhardness tester with a load of 25 g. It is understood that the materials of the inventive examples have hardness equal to or more than that of nickel silver (Comparative Example 10) currently used as a part for fastener, and are provided with mechanical properties such as strength or hardness, suitable as a fastener part.

Further, 80% strain was given to the test materials obtained, by a cold compression test, and the presence or absence of crack on the surface was observed.

In Table 1, "O" shows that crack was not present on the material surface, and "X" shows that crack was present on the material surface. It is understood that in all the materials of the inventive examples, crack was not present on the surface. Although in the use as case of elements of a fastener, 80% strain at the maximum is given in the cold when affixing the elements to a cloth as mentioned above, it is understood that the materials of the inventive examples have no problem even if 80% strain is given in the cold.

Discoloration resistance was examined in such a manner that the test materials obtained were subjected to mirror polishing with a SiC polishing paper and a diamond paste and a constant temperature and humidity test was conducted by exposing to exposed to an atmosphere of 80° C. and 90% RH. The surface of the test materials thereafter were measured using the calorimetric color-difference meter. Evaluation of the discoloration resistance was conducted based on numerical values obtained by introducing indexes before and after the constant temperature and humidity test into the following equation.

$$\text{Discoloration}=\sqrt{(a^*)^2+(b^*)^2+(L^*)^2}-\sqrt{(a'^*)^2+(b'^*)^2+(L'^*)^2}$$

(In the formula, a*, b* and L* are indexes before the constant temperature and humidity test, and a'*, b'* and L'* are indexes after the constant temperature and humidity test.)

It is clear from the test results shown in Table 1 that the materials of the inventive examples give small values in the above-mentioned equation and have excellent discoloration resistance. From this fact, it is understood that when the inventive materials is used as a fastener part, such a fastner part exhibits high discoloration resistance to washing with warm water. In this test, washing with warm water in Europe is conducted as a standard.

The season cracking resistance was evaluated as follows. 80% strain was given to the test materials by a cold compression test, the test materials were exposed to ammonia exposure using a 12.5% aqueous ammonia solution, and occurrence of crack on the surface was observed. In Table 1, "O" shows that crack was not present on the material surface, and "X" shows that crack was present on the material surface. It is understood that in all the materials of the inventive examples, crack was not present on the surface. From this fact, it is understood that the present invention can provide a material that is not subjected to problems such as crack due to strain applied even when fitted and affixed to a cloth as fastener elements.

TABLE 1

| | | Alloy composition | | | | | | | |
|---|---|---|---|---|---|---|---|---|---|
| | | Cu | Zn | Mn | Al | Ti | Si | Cr | Ni |
| Example | 1 | Balance | 2.5 | 14 | 1 | — | | | — |
| | 2 | Balance | 3 | 15 | 2 | — | — | — | — |
| | 3 | Balance | 2 | 10 | 1 | — | — | — | — |
| | 4 | Balance | 4 | 15 | 1 | — | — | — | — |
| | 5 | Balance | 4 | 7 | 1 | — | — | — | — |
| | 6 | Balance | 4 | 15 | 0.5 | — | — | — | — |
| | 7 | Balance | 1 | 14 | 0.5 | — | — | — | — |
| | 8 | Balance | 2.5 | 14 | 1 | 0.05 | — | — | — |

TABLE 1-continued

| | | | | | | | | | | |
|---|---|---|---|---|---|---|---|---|---|---|
| | 9 | Balance | 2.5 | 14 | 1 | — | 0.05 | — | — |
| | 10 | Balance | 3 | 14 | 1 | — | — | 0.02 | — |
| | 11 | Balance | 2.5 | 13 | 1 | — | 0.1 | — | — |
| | 12 | Balance | 2 | 14 | 1 | — | 0.3 | — | — |
| | 13 | Balance | 2.5 | 12 | 1 | — | 0.05 | 0.02 | — |
| | 14 | Balance | 2.5 | 14 | 1 | 0.05 | 0.05 | — | — |
| Comparative Example | 1 | Balance | 2.5 | 14 | 5 | — | — | — | — |
| | 2 | Balance | 3 | 5 | 1 | — | — | — | — |
| | 3 | Balance | 2.5 | 20 | 1 | — | — | — | — |
| | 4 | Balance | 2.5 | 20 | 1 | — | 0.5 | — | — |
| | 5 | Balance | 2.5 | 25 | 4 | — | — | — | — |
| | 6 | Balance | 24 | 5 | 3 | — | — | — | — |
| | 7 | Balance | 2.5 | 14 | 1 | 0.5 | — | — | — |
| | 8 | Balance | 2.5 | 14 | 1 | — | 0.5 | — | — |
| | 9 | Balance | 4 | 14 | 1 | — | — | 0.5 | — |
| | 10 | Balance | 24 | — | — | — | — | — | 13 |

| | | Color tone | | | | | Existence of | | Season |
|---|---|---|---|---|---|---|---|---|---|
| | | Color tone | a* | b* | Structure | Hardness (Hv) | crack after 80% deformation | Discoloration | cracking resistance |
| Example | 1 | White | 3.09 | 9.66 | α | 110 | ○ | 6.09 | ○ |
| | 2 | White | 3.12 | 9.78 | α | 113 | ○ | 6.48 | ○ |
| | 3 | White | 4.52 | 10.27 | α | 105 | ○ | 6.15 | ○ |
| | 4 | White | 3.01 | 7.75 | α | 114 | ○ | 6.24 | ○ |
| | 5 | White | 3.08 | 9.63 | α | 113 | ○ | 6.12 | ○ |
| | 6 | White | 2.86 | 9.41 | α | 113 | ○ | 6.23 | ○ |
| | 7 | White | 3.03 | 9.73 | α | 111 | ○ | 6.93 | ○ |
| | 8 | White | 2.89 | 9.09 | α | 101 | ○ | 6.73 | ○ |
| | 9 | White | 3.00 | 9.87 | α | 102 | ○ | 5.17 | ○ |
| | 10 | White | 3.03 | 9.66 | α | 101 | ○ | 5.49 | ○ |
| | 11 | White | 3.62 | 7.07 | α | 131 | ○ | 7.15 | ○ |
| | 12 | White | 3.29 | 9.40 | α | 154 | ○ | 7.52 | ○ |
| | 13 | White | 3.53 | 8.18 | α | 130 | ○ | 8.53 | ○ |
| | 14 | White | 3.30 | 8.33 | α | 172 | ○ | 5.86 | ○ |
| Comparative Example | 1 | White | 1.48 | 10.38 | α + secondary phase | 156 | x | 9.68 | ○ |
| | 2 | Yellow | 9.54 | 13.85 | α | 85 | ○ | 7.68 | ○ |
| | 3 | White | 2.95 | 5.84 | α | 116 | ○ | 14.61 | ○ |
| | 4 | White | 2.95 | 5.84 | α | 136 | ○ | 14.67 | ○ |
| | 5 | White | 1.43 | 2.86 | α + secondary phase | 164 | x | 17.56 | ○ |
| | 6 | Yellow | −0.70 | 7.24 | α + secondary phase | 125 | x | 9.68 | x |
| | 7 | White | 3.08 | 9.68 | α + secondary phase | 165 | x | 5.63 | ○ |
| | 8 | White | 3.10 | 9.65 | α + secondary phase | 153 | x | 5.47 | ○ |
| | 9 | White | 3.06 | 9.71 | α + secondary phase | 157 | x | 5.24 | ○ |
| | 10 | White | 1.14 | 7.87 | α | 110 | ○ | 5.25 | ○ |

The present invention provides a nickel-free copper alloy, which has excellent strength and hardness equal to those of nickel silver, as well as excellent workability and corrosion resistance in addition to ductility. Even if it is used as elements, sliders, stoppers or the like for fasteners, or accessories such as buttons, stoppers or the like for clothes, and those articles contact with a skin, since it is Ni free, there is no fear of allergic reactions to those articles and a beautiful white is maintained, so that decorative value is high.

What is claimed is:

1. A nickel-free white copper alloy represented by the general formula: $Cu_aZn_bMn_cAl_d$, wherein b, c, and d are $0.5 \leqq b < 5$, $7 \leqq c \leqq 17$ and $0.5 \leqq d \leqq 4$ in terms of % by weight; and a is the balance, said alloy incidentally including unavoidable elements.

2. A nickel-free white copper alloy, represented by the general formula: $Cu_aZn_bMn_cAl_dX_e$, wherein X is at least one element selected from the group consisting of Si, Ti and Cr; b, c, d and e are $0.5 \leqq b < 5$, $7 \leqq c \leqq 17$, $0.5 \leqq d \leqq 4$ and $0 < e \leqq 0.3$ in terms of % by weight; a is the balance, and said alloy incidentally including unavoidable elements.

3. The nickel-free white copper alloy according to claim 1, wherein said b, c and d are $0.5 \leqq b \leqq 4$, $7 \leqq c \leqq 15$ and $0.5 \leqq d \leqq 2$ in terms of % by weight.

4. The nickel-free white copper alloy according to claim 2, wherein said b, c and d are $0.5 \leqq b \leqq 4$, $7 \leqq c \leqq 15$ and $0.5 \leqq d \leqq 2$ in terms of % by weight.

5. The nickel-free white copper alloy according to claim 1, wherein said alloy is in a single α-phase state at room temperature.

6. The nickel-free white copper alloy according to claim 2, wherein said alloy is in a single α-phase state at room temperature.

7. The nickel-free white copper alloy according to claim 1, wherein said alloy has such a color tone that a* value and b* value representing a color tone defined by JIS Z 8729 are $0 < a^* < 5$ and $7 < b^* < 15$.

8. The nickel-free white copper alloy according to claim 2, wherein said alloy has such a color tone that a* value and b* value representing a color tone defined by JIS Z 8729 are $0<a^*<5$ and $7<b^*<15$.

9. The nickel-free white copper alloy according to claim 3, wherein said alloy is in a single α-phase state at room temperature.

10. The nickel-free white copper alloy according to claim 4, wherein said alloy is in a single α-phase state at room temperature.

* * * * *